US005297519A

United States Patent [19]

Simons

[11] Patent Number: 5,297,519

[45] Date of Patent: Mar. 29, 1994

[54] METHOD AND APPARATUS FOR DIRECT FUEL INJECTION IN AN INTERNAL COMBUSTION ENGINE

[76] Inventor: Syilvan Simons, 45 Don Bosco Pl., Port Chester, N.Y. 10573

[21] Appl. No.: 836,868

[22] Filed: Feb. 19, 1992

[51] Int. Cl.[5] ..... F02B 3/00

[52] U.S. Cl. ..... 123/298

[58] Field of Search ..... 123/298, 143 B, 169 R, 123/169 EL, 603, 606, 607, 620, 169 PB, 637, 608

[56] References Cited

U.S. PATENT DOCUMENTS

| | | | |
|---|---|---|---|
| 3,589,348 | 6/1971 | Reichhelm | 123/169 PB |
| 3,680,538 | 8/1972 | Scherenberg | 123/169 PB |
| 4,774,914 | 10/1988 | Ward | 123/620 |
| 4,858,586 | 8/1989 | Kanno | 123/620 |
| 5,058,548 | 10/1991 | Morikawa et al. | 123/298 |

*Primary Examiner*—Raymond A. Nelli

*Attorney, Agent, or Firm*—Alfred E. Miller

[57] ABSTRACT

A method and apparatus for the ignition of fuel injected into an internal combustion engine, wherein combustion is initiated by spraying fuel directly onto a spark plug with heated electrodes. The heating of the electrodes may be effected energizing them independently of the engine rotation.

15 Claims, 5 Drawing Sheets

FIG.3
PRIOR ART
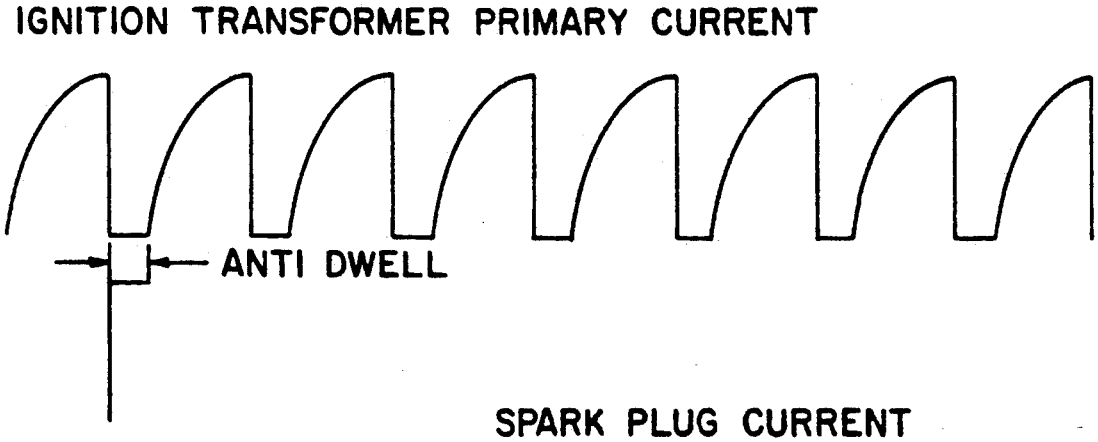
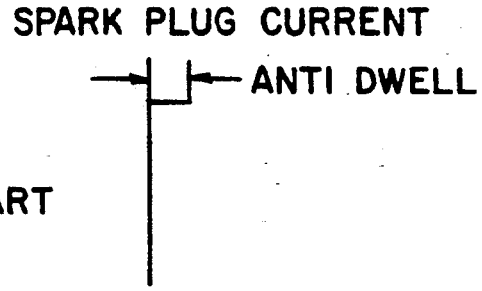
FIG.4
PRIOR ART
FIG.5
PRIOR ART
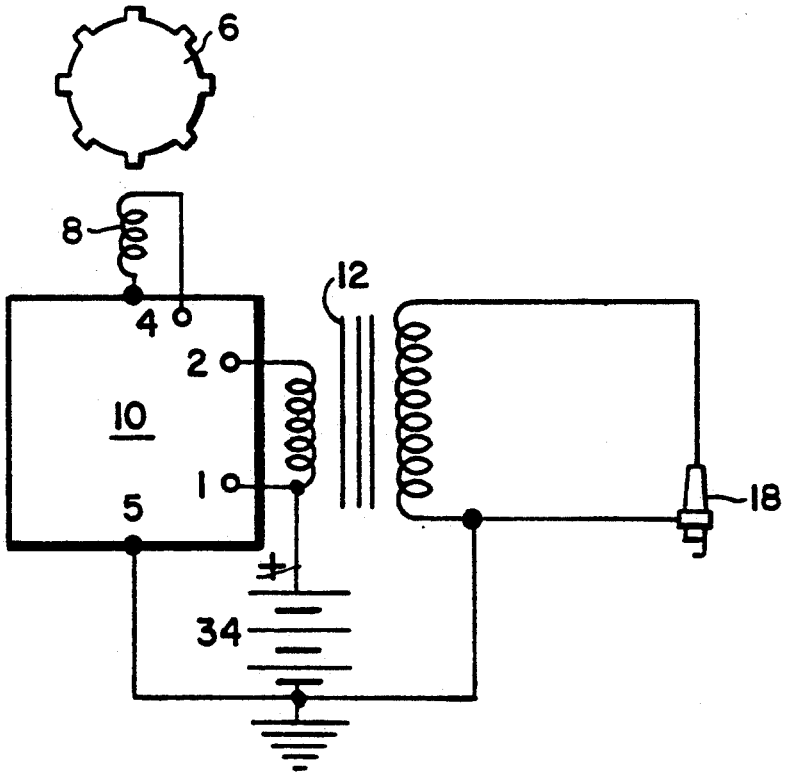

SPARK PLUG CURRENT W/ MULTIPLE ACTIVATION

METHOD AND APPARATUS FOR DIRECT FUEL INJECTION IN AN INTERNAL COMBUSTION ENGINE

FIELD OF THE INVENTION

The invention is directed to an improved method and apparatus for igniting fuel in an internal combustion engine.

BACKGROUND OF THE INVENTION

For many years it has been proposed to employ direct fuel injection in spark ignited internal combustion engine, in order to improve engine performance. Spraying fuel directly onto the spark plug provides a rich fuel to initiate combustion, and the combustion chamber provides the air necessary to complete combustion, as compared to the homogeneous mixture of a conventional spark ignited engines where the mixture has to be rich enough in fuel to initiate combustion, but in which there is insufficient air to complete combustion. In this latter case, the combustion must continue in a catalytic converter with the consequent waste of energy.

Previous attempts at direct fuel injection have been inhibited due to the tendency of the sprayed fuel to extinguish the sparking when contacting the spark plug electrodes. As a solution to this problem, it has been proposed to reduce the quantity of fuel directed at the electrodes. Such schemes have avoided direct contact with the spark plug, for example by spraying the fuel in close proximity as illustrated in FIG. 2, by either spraying the fuel in a pattern such that only a portion of the injected fuel contacts the spark plug, or by preatomization of the fuel with air.

Since gasoline is easier to vaporize and ignite than diesel fuel, the gasoline has been preferred as the fuel when injecting fuel for spark ignition.

Since gasoline lacks the lubrication qualities of diesel fuel that are essential to the durability of the injection components, however, the use of diesel fuel would be preferred in such a system, if it is possible to effect ignition of a diesel fuel in an efficient manner, which the ignition system in accordance with the invention accomplishes.

FIG. 1 is circuit diagram of a conventional ignition system employing a reluctor 6 mounted to rotate half engine speed together with distributor rotor 16. In this arrangement, the reluctor generates a pulse in pick-up coil 8 in accordance with distributor and engine rotation. The pulse is shaped and amplified by an ignition module 10, such as a Chrysler ignition module, which in conjunction with battery 34 energizes the ignition transformer 12. Numbers 1 through 5 in the module 10 represent the pin numbers of the Chrysler module 10.

In this system, each spark plug 18, 20, 22, 24, 26, 28, 30. 32 is activated once every two engine revolutions, during the anti-dwell period of the ignition module 10. FIG. 3 illustrates the ignition transformer primary current, in this system, and FIG. 4 illustrates the spark plug current. The position of the distributor rotor 14 determines which spark plug is being activated.

If each cylinder with spark plug has its own ignition system as shown in FIG. 5, the 8 toothed reluctor from an 8 cylinder engine will generate 8 pulses and spark plug firings per engine revolution as shown FIG. 6 instead of the customary spark plug firing every other engine revolution as shown in FIG. 3. The 8 pulses and spark plug firings as shown in FIG. 6 would occur with the reluctor 6 rotating at the same speed as engine, whereas FIG. 4 is shown with the reluctor rotating at the half speed of the engine distributor.

FIG. 7 illustrates the ignition system of FIG. 5 enhanced with auxiliary ignition system as disclosed in my copending patent application Ser. No. 07/637,607, the contents of which are incorporated by reference here. In this arrangement, pick up coil 8 in conjunction with reluctor 6, which rotates at half engine speed for a 4 stroke engine, generates a pulse to activate the ignition module 10 which in turn activates transformer 42 The transformer 42 is a Kettering high voltage inductive discharge transformer with 3 taps for by-pass diodes 46, 48, 50 and 52. These diodes may be 12,000 volt Fagor #HVR-12 diodes. The transformer 42 is tapped to "lock in" the voltage across each diode so that the voltage divides equally between the diodes as described in my patent application Ser. No. 636,607.

The diodes provide a low impedance path for the inductive discharge current from auxiliary transformer 44 which may be a Thordarson CFP-700 transformer with a 230 volt primary and a 10 volt secondary operated with the winding functions reversed so that the 10 volt winding is used as the primary and the 230 volt winding is the secondary. Module 36 is a Chrysler ignition pulse shaper-amplifier module with its current output capacity increased by use of a higher current output transistor. A 1,000 ohm Resistor 38 connects module 36 to the pick coil 8 causing a phase delay allowing module 36 in conjunction with transformer 44 to discharge current after the sparking has been initiated in spark plug 18. Since transformer 44 is of higher volt ampere capacity and lower secondary winding resistance and impedance than the Kettering transformer 42, the current and the sparking at spark plug 18 is greatly increased.

In the arrangement of FIG. 7, a 1.3 ohm "Ballast" resistor 40 and a 0.5 ohm "Ballast" resistor 41 reduce current fluctuation when the starter motor of the engine is engaged, in accordance with a technique well known to those skilled in the art.

FIG. 2 illustrates a known prior art arrangement for a direct fuel injected internal combustion engine. It is noted that in this arrangement the fuel is not sprayed directly onto the spark plug since this would generally extinguish the sparking. Instead, the fuel is sprayed close to the spark plug and depends upon air movement or "swirl" for contact to be made between fuel and sparking. This technique has accordingly been found to be unreliable.

SUMMARY OF THE INVENTION

Briefly stated, the invention is directed to the provision of an ignition method and system for supplying the spark plug of an internal combustion engine with sufficient energy to heat the electrodes to be so hot that ignition results when fuel is sprayed directly onto the heated electrodes, and reducing risk of extinction of the arc.

BRIEF DESCRIPTION OF THE DRAWING

In order that the invention may be more clearly understood, it will now be disclosed in greater detail with reference to the accompanying drawing, wherein:

FIG. 3 illustrates the waveform of the ignition transformer primary current of the circuit of FIG. 1;

FIG. 4 illustrates the waveform of the spark plug current of the circuit of FIG. 1;

FIG. 5 illustrates a modification of a portion of the circuit of FIG. 1;

DETAILED DISCLOSURE OF THE INVENTION

In accordance with the invention, the sparking device in an engine is energized for a time greatly exceeding the time at which ignition is to occur, in order to enable the sparking device to be heated to such an extent that the fuel may be sprayed directly onto the sparking device without danger of extinction of the arc.

Figure 1:
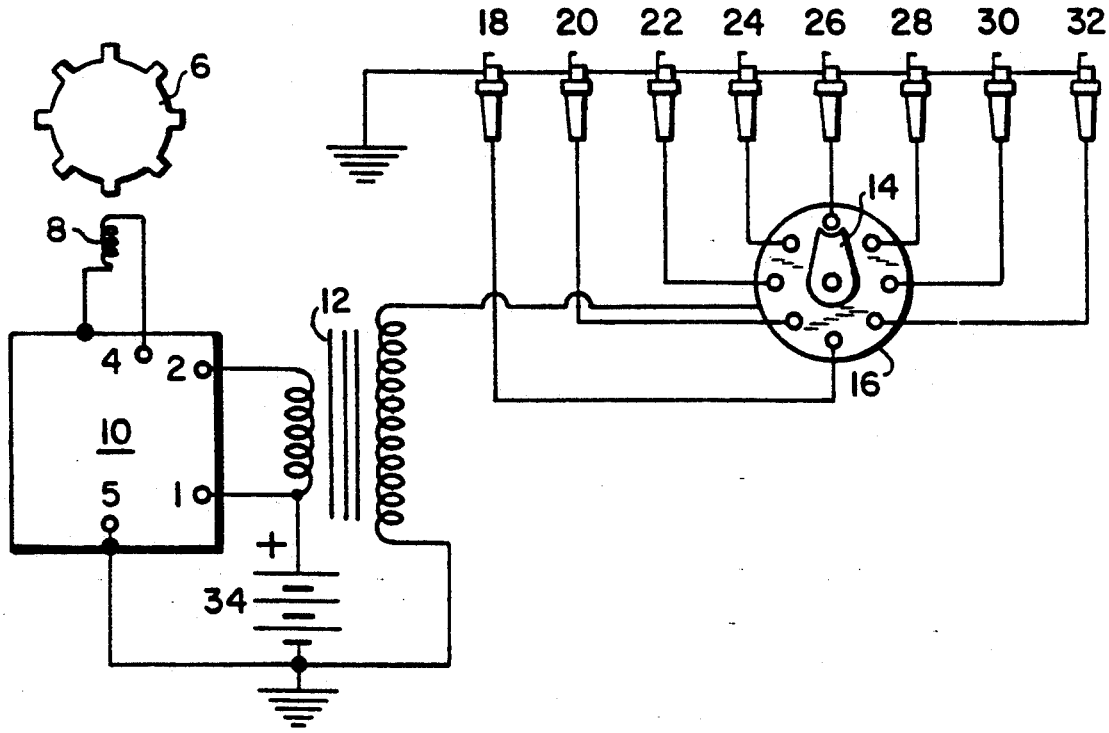
FIG.1 PRIOR ART
FIG. 1 illustrates the circuit diagram of a conventional system.
Figure 2:
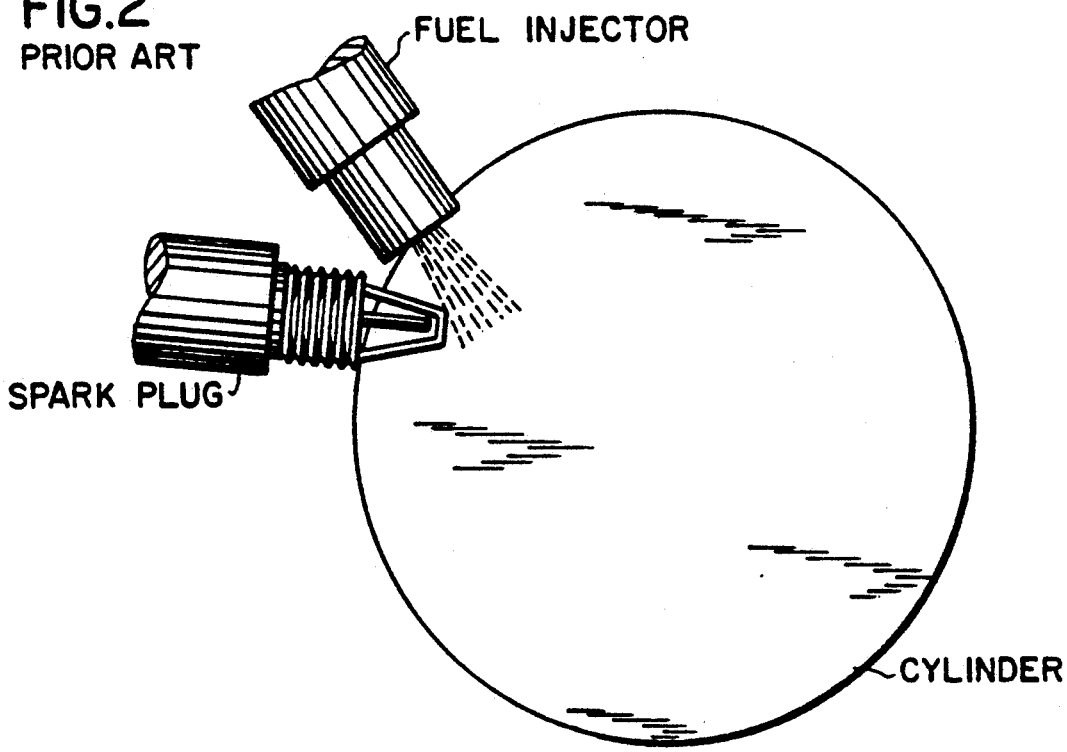
FIG.2 PRIOR ART
FIG. 2 illustrates the spraying of a fuel in a cylinder, in a proposed prior art ignition system.
Figure 6:
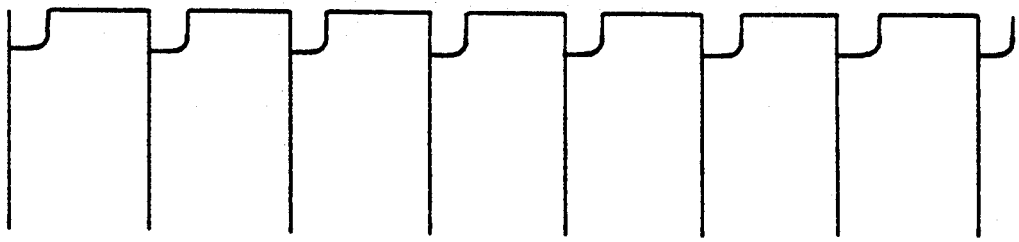
FIG.6 PRIOR ART
FIG. 6 illustrates the waveform of an engine employing the circuit of FIG. 5.
Figure 7:
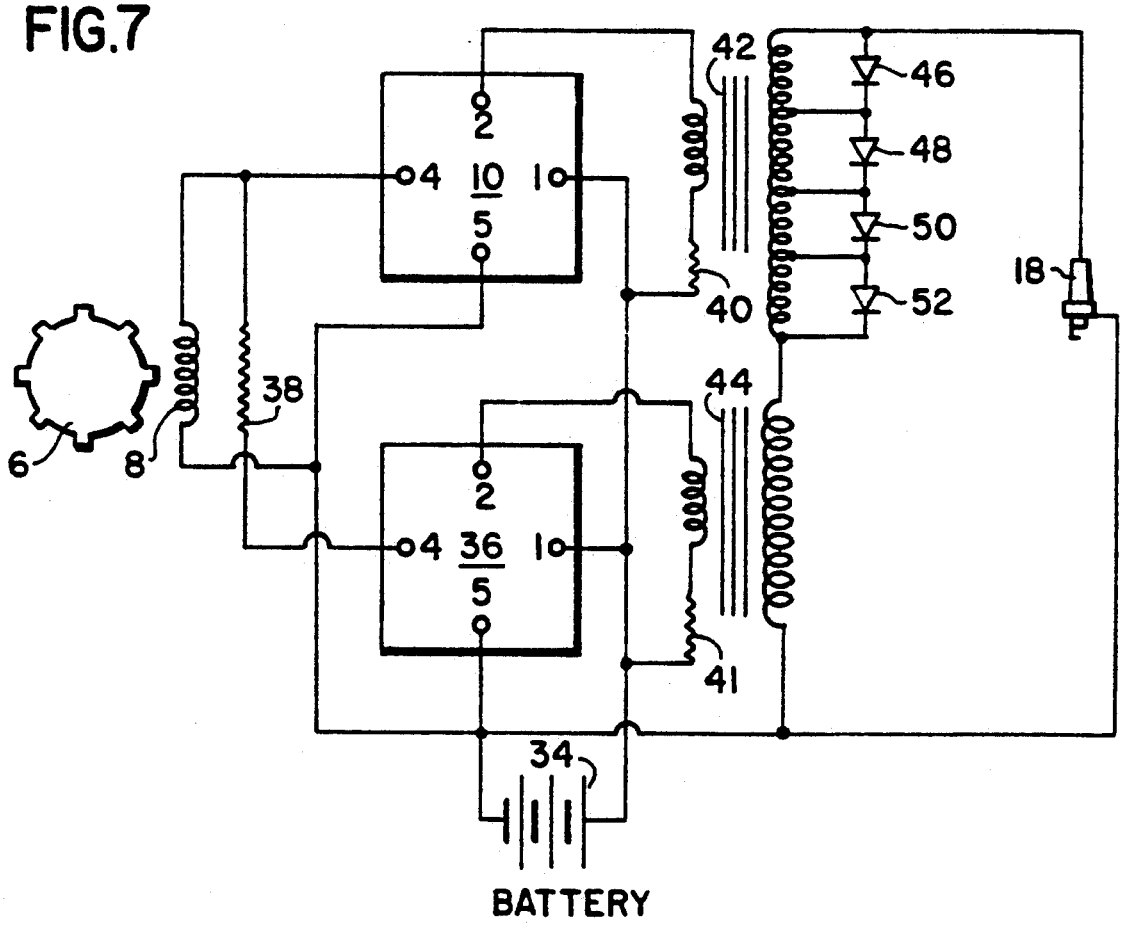
FIG. 7 is a circuit diagram of an improved ignition circuit in accordance with my above copending patent application.
Figure 8:
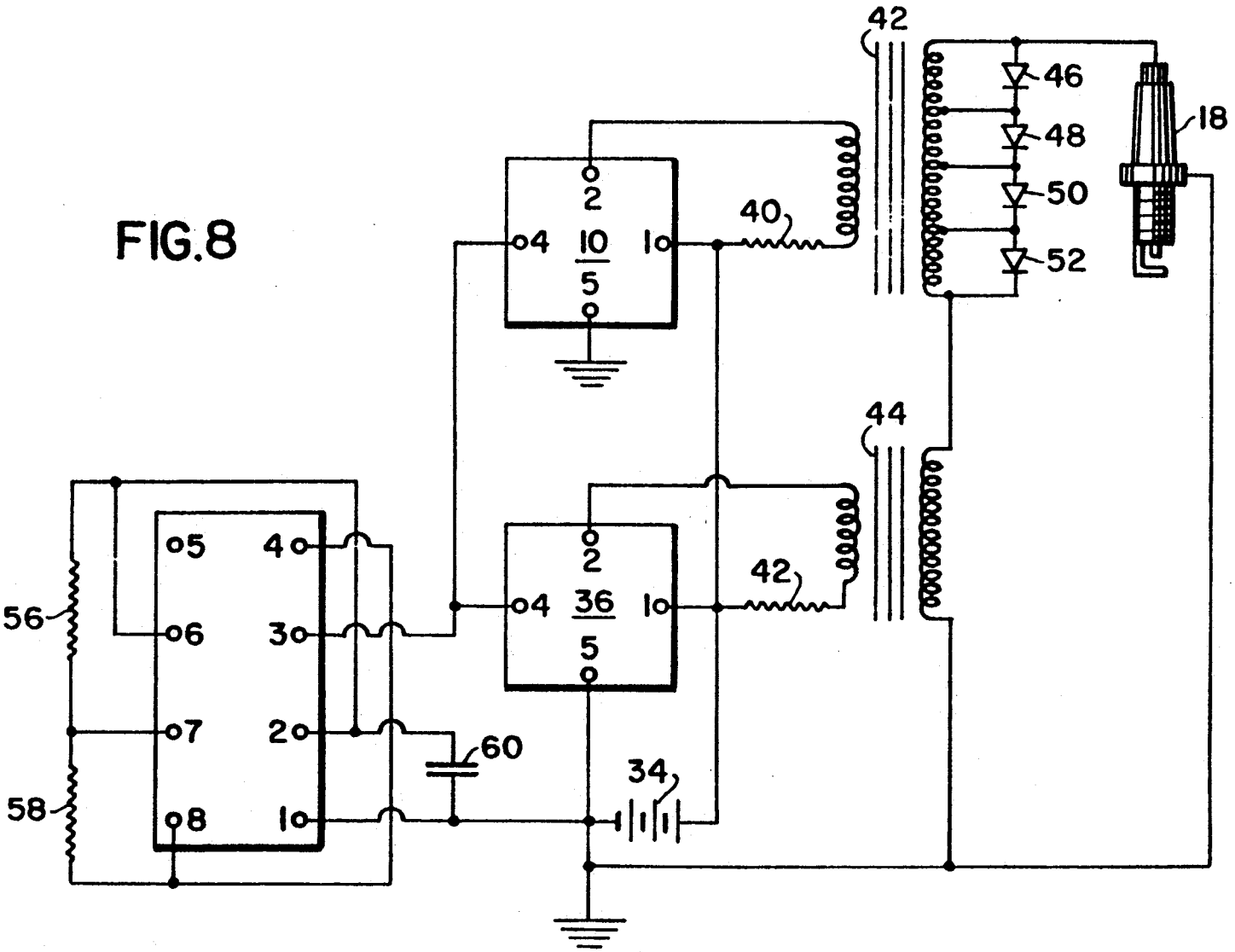
FIG. 8 is a circuit diagram of a system in accordance with the invention.
Figure 10:
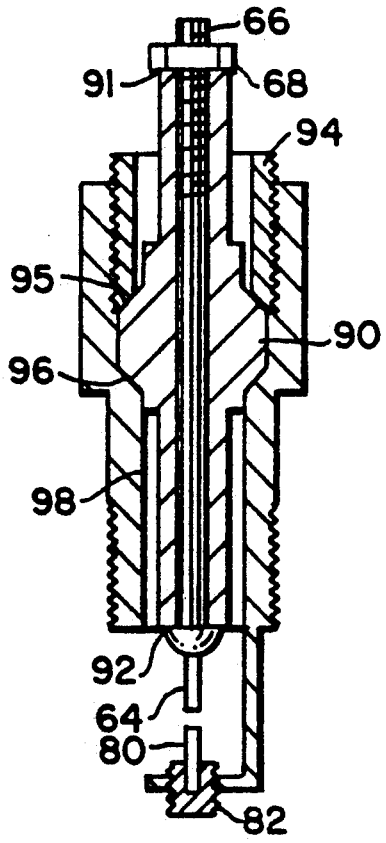
FIG. 10 is a cross sectional view of a sparking device that may be employed with the enhanced ignition system of the invention.

Since ignition is effected by the contacting of the hot electrodes by the fuel, in accordance with the invention it is not necessary for the sparking to be synchronized with engine rotation. FIG. 10 is an ignition circuit utilizing this technique. One system in accordance with the invention for effecting this result is illustrated in FIG. 8. It will be apparent that this circuit is a modification of the circuit of FIG. 7, and elements in FIG. 8 that are the same as those of FIG. 7 are identified by the same reference numerals.

Referring now to FIG. 8, the usual pick up coil and toothed rotor is replaced by an astable multivibrator 54, which may be, for example, a type 555 integrated circuit. Pin numbers 1 through 8 illustrated on this device correspond to the pin numbers of a type 555 multivibrator. The multivibrator generates output pulses at pin 3 to activate the ignition pulse shaper-amplifier module 10 which, as above discusses, may be a Chrysler Motors module. The module 10 in turn energizes the tapped high voltage ignition transformer 42, which has been previously described, and initiates sparking at the spark plug 18. Similarly, the multivibrator 54 energizes the module 36 which in turn energizes the low voltage transformer 44, in the previously described manner, to increase the current and the sparking at the spark plug 18. Diodes 46, 48, 50 and 52 provide a low impedance path, previously described, for current from transformer 44.

As discussed above, ballast resistors 40 and 42 serve to steady current flow with extremes of full battery voltage of 13.5 volts to reduced voltage of as low as 5 volts when starter is engaged on a cold day, by offering minimum resistance when cold and maximum resistance when hot. Such resistors are widely available from ignition component suppliers.

The capacitor 60 is 0.1 microfarad 50 volt rated capacitor, and together with 12,000 ohm resistor 56 and 18,000 ohm resistor 58 determines the frequency of oscillation of the multivibrator 54. These components provide an output of about 350 Hertz from the multivibrator, i.e. substantially higher than the rate at which sparking devices are conventionally energized. The Battery 60 is conventional automobile storage battery.

Figure 9:
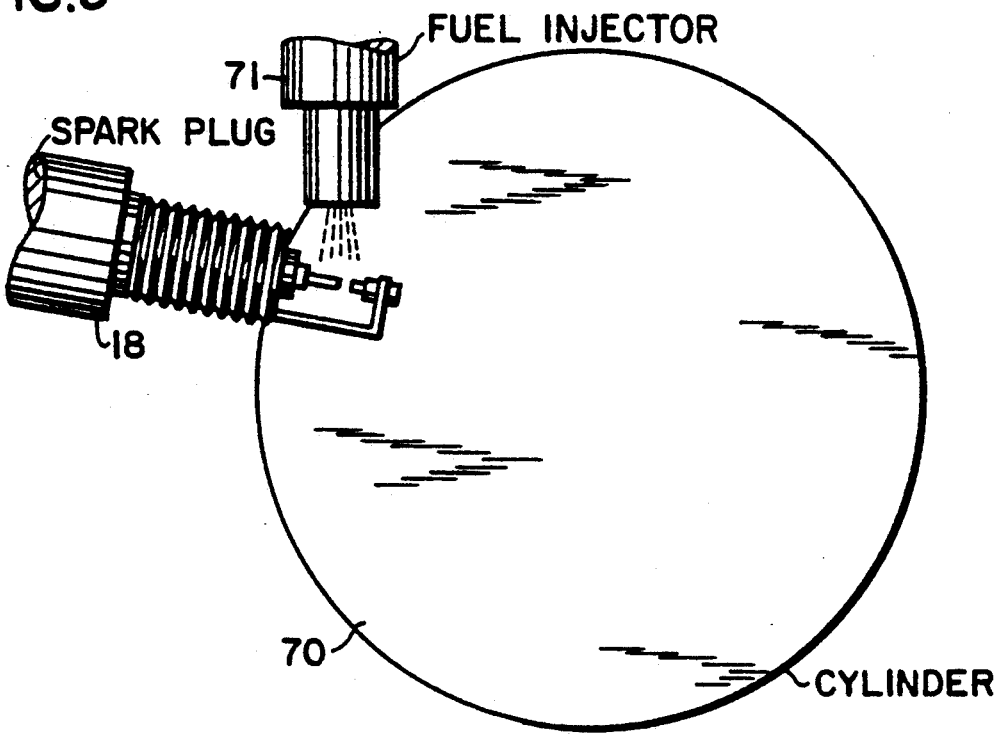
FIG. 9 illustrates the injection of the fuel directly on the electrodes of a sparking device, in accordance with the invention.

As illustrated in FIG. 9 in accordance with my invention, fuel is sprayed into the cylinder 70 from the fuel injector 71, directly onto the electrodes of the spark plug, at the location of the arc, for reliable ignition. It is apparent, however, that this technique can only be used with an enhanced ignition system in accordance with the invention as above discussed, wherein spark extinction is not a problem.

It has been found that conventional spark plugs are not generally suitable to accommodate the higher energy levels of the enhanced ignition system in accordance with the invention. It has been found that the electrodes should be "in-line" if the sparking "kernel" is not to be restricted in size and thereby put additional strains on the spark plug electrodes. The term "in-line" as used herein, refers to the construction wherein the electrodes extend generally linearly on the same axis toward one another.

FIG. 10 is a cross sectional view of a spark plug that has been found to be suitable for use in the enhanced ignition system of the invention. As illustrated in this figure, the spark plug is constructed with platinum group metal electrodes to accommodate the higher energy output of the enhanced ignition system with its higher electrode temperatures. Iridium is the preferred platinum group metal since it is capable of withstanding the most extreme temperature of the commercially available group.

Electrode 64 is a 1 millimeter diameter $\times \frac{1}{4}$ long iridium wire fitted and brazed to a 6–32 diameter $\times 2\frac{1}{2}$ inch long brass screw 66. Electrode 80 is also a 1 millimeter diameter $\times \frac{1}{4}$ inch long and is fitted and brazed to a cut off 6–32 screw 82 that can be screwed in or out to adjust the air gap between electrodes. This gap was generally set at 0.030 inches. It is of course apparent that the electrode size and shape will be varied to accommodate particular engine conditions.

The $10\text{–}32 \times 2\frac{1}{2}$ inch screw 66 is held in place in ceramic insulator 90 that has been drilled through its axis to accept screw 66. Screw 66 is held in place with nut 68 and sealed in a gas tight manner using copper washers 91 and 92.

Ceramic insulator 90 is held in place in threaded spark plug body 98 by threaded cap 94, the assembly being made gas tight with beveled copper washers 95 and 96 which are preformed to fit the contour of ceramic insulator 90.

It is of course apparent that the spark plug is not limited to this specific configuration.

While as above discussed, it is not necessary for the energization of the sparking device to be synchronized with the rotation of the engine, it is apparent that the invention is not limited to asynchronous operation, or operation independent of rotation of the engine, as long as the sparking device is energized sufficiently to reliably effect the above discussed heating of the sparking device to aid ignition of the fuel, so that the spraying of fuel thereon involves no risk of extinction of the arc.

While the invention has been disclosed and described with reference to a single embodiment, it will be apparent that variations and modification may be made therein, and it is therefore intended in the following claims to cover each such variation and modification as falls within the true spirit and scope of the invention.

I claim:

1. In an ignition system for an internal combustion engine having spark plug electrodes and means for injecting fuel, the improvement comprising means for heating said spark plug electrodes to a temperature at which said fuel is ignited on contact therewith, and wherein said means for injecting fuel comprises means for spraying fuel directly against said heated electrodes for igniting said fuel.

2. The ignition system of claim 1 wherein said means for heating comprises means for applying a plurality of inductive discharges to said spark plug electrodes, said temperature being sufficiently high to avoid extinctions of said discharges by the spraying of said fuel on said electrodes.

3. The ignition system of claim 2 wherein said means for applying a plurality of inductive discharges comprises a Kettering type ignition system.

4. The ignition system of claim 2 wherein said means for applying a plurality of inductive discharges comprises means for applying said inductive discharge to said spark plug more frequently than is necessary for spark ignition.

5. The ignition system of claim 1 wherein said spark plug electrodes are thin in-line electrodes.

6. The ignition system of claim 1 wherein said means for applying a plurality of inductive discharges to said spark plug electrodes comprises means for continuously generating said inductive pulses at a rate independent of engine rotation of said internal combustion engine, and said heating means comprises means for heating said electrodes to a temperature to avoid extinction of said discharges by the spraying of said fuel on said electrodes.

7. The ignition system of claim 6 wherein said means for generating pulses comprises an oscillator.

8. The ignition system of claim 7 wherein said oscillator comprises an astable multivibrator.

9. The ignition system of claim 2 wherein said means for applying a plurality of inductive discharges to said spark plug electrodes comprises means for applying pulses to said electrodes that have high voltage low current initial portions followed by high current low voltage portions.

10. A method for igniting fuel in an internal combustion engine having spark plug electrodes and means for injecting fuel into a cylinder of the engine, the improvement comprising heating said spark plug electrodes to a temperature sufficient to ignite fuel sprayed thereon without extinction of an arc, and spraying said fuel directly against said heated electrodes for igniting said fuel.

11. The method of claim 10 wherein said step of heating said electrodes comprises applying a plurality of inductive voltage pulses to said electrodes for each cycle, to produce discharges at said electrodes, and said step of heating said electrodes comprises heating said electrodes to a temperature at which extinction of said discharges is prevented.

12. The method of claim 11 wherein said step of applying pulses comprises generating said pulses asynchronously with respect to rotation of said engine.

13. The method of claim 12 wherein said step of generating pulses asynchronously comprises continuously generating said pulses at a given rate.

14. The ignition system of claim 6 wherein said means for generating said inductive pulses at a rate independent of engine rotation of said internal combustion engine comprises means for continuously generating said inductive pulses at a rate that is asynchronous with respect to said engine rotation.

15. The ignition system of claim 6 wherein said means for generating said inductive pulses at a rate independent of engine rotation of said internal combustion engine comprises means for continuously generating said inductive pulses at said rate.

* * * * *